US006641094B2

(12) United States Patent
Fishler

(10) Patent No.: US 6,641,094 B2
(45) **Date of Patent: *Nov. 4, 2003**

(54) PLUSH BOTTLE HOLDER

(75) Inventor: Brenda C. Fishler, Santa Clarita, CA (US)

(73) Assignee: Baby Dayz Co., Inc., Santa Clarita, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/178,150

(22) Filed: Jun. 24, 2002

(65) Prior Publication Data

US 2003/0015630 A1 Jan. 23, 2003

Related U.S. Application Data

(63) Continuation-in-part of application No. 10/053,092, filed on Jan. 23, 2002.
(60) Provisional application No. 60/265,678, filed on Feb. 2, 2001.

(51) Int. Cl.[7] ..... A47D 15/00; A61J 9/06
(52) U.S. Cl. ..... 248/102; 248/103; 248/105
(58) Field of Search ..... 248/102, 103, 248/105; D24/198, 199

(56) References Cited

U.S. PATENT DOCUMENTS

| | | | | | |
|---|---|---|---|---|---|
| 530,435 | A | * | 12/1894 | Lowerre | 248/102 |
| D15,611 | S | * | 9/1946 | Butterfield | D83/8 |
| 2,409,820 | A | * | 10/1946 | Zimmern | 215/12.1 |
| 4,277,910 | A | * | 7/1981 | Kramer | 446/73 |
| D287,636 | S | * | 1/1987 | Callju | D24/47 |
| 4,809,938 | A | * | 3/1989 | Skinner et al. | 248/102 |
| D305,346 | S | * | 1/1990 | Roberts | D21/162 |
| D314,432 | S | * | 2/1991 | Shaw | D24/48 |
| 4,989,811 | A | * | 2/1991 | Millis et al. | 248/104 |
| 5,072,843 | A | * | 12/1991 | James | 215/395 |
| D327,128 | S | * | 6/1992 | Nightingale | D24/199 |
| 5,217,192 | A | * | 6/1993 | Oktayuren | 248/102 |
| 5,419,447 | A | * | 5/1995 | Lim | 215/398 |
| 5,421,496 | A | * | 6/1995 | Korsinsky et al. | 224/148.2 |
| D402,761 | S | * | 12/1998 | Jones | D24/199 |
| 5,871,184 | A | * | 2/1999 | Kaopio | 248/102 |
| 5,979,843 | A | * | 11/1999 | Beck | 248/102 |
| 6,003,821 | A | * | 12/1999 | Fabian et al. | 248/104 |
| 6,082,681 | A | * | 7/2000 | Rand | 248/102 |

OTHER PUBLICATIONS

The Milk Bottle Bear, http://www.bababear, 1999.*

* cited by examiner

*Primary Examiner*—Leslie A. Braun
*Assistant Examiner*—Amy J. Sterling
(74) *Attorney, Agent, or Firm*—Leydig, Voit & Mayer, Ltd.

(57) ABSTRACT

A holder for a bottle that forms an animal or creature when the bottle is inserted in the holder is provided. The holder comprises a body having an internal passage extending therethrough from a rear opening in the body to a front opening in body. The internal passage is configured to receive a bottle with a portion of the bottle extending beyond the front opening in the body. The body is configured and the front opening is arranged on the body such that the portion of the bottle extending beyond the front opening forms a feature of a face of the animal or creature. The body is pliable or compressible such that the body can be compressed for storage and the internal passage can receive bottles of varying size.

5 Claims, 5 Drawing Sheets

PLUSH BOTTLE HOLDER

CROSS-REFERENCE TO RELATED APPLICATIONS

This patent application is a continuation-in-part of copending U.S. Pat. application Ser. No. 10/053,092, filed Jan. 23, 2002, which claims the benefit of U.S. Provisional Patent Application No. 60/265,678, filed Feb. 2, 2001, the entire disclosures of which are incorporated herein by reference in their entireties.

FIELD OF THE INVENTION

The present invention relates to bottle covers and more specifically to an improved holder for a baby bottle or other one-pint bottles that provides insulation for a variety of bottle shapes as well as amusement for the user.

BACKGROUND OF THE INVENTION

Infant care givers commonly attempt to simplify their care giving by using products that are either time-saving or amusing to the infant. Most babies have a preference for the temperature of their bottle. Care givers find maintaining the fluid temperature time consuming. Traditional bottle insulators maintain the fluid's temperature until the infant requires nourishment, however once the bottle is taken out of the holder the temperature quickly adjusts to the environment's temperature. Care givers also spend much of their time amusing the infant with toys such as stuffed animals.

Many bottle covers have been provided in prior art. Some examples are Gammerlgaard U.S. Pat. No. 5,624,090 where the bottle is held by a stuffed animal for hands-free feeding of the infant but is made up of two separate pieces. The bottle holder by Oktayuren U.S. Pat. No. 5,217,192 is a stuffed animal holding a bottle but does not provide any insulation benefits. These are all illustrative of such prior art. These inventions are suitable for their intended purpose but they do not meet the needs that the plush bottle holder does, heretofore described.

Most of the previous designs for bottle holders are either purely functional or purely decorative. They lack a simple combination of the two qualities.

U.S. Pat. No. 5,871,184 "Holder for a Baby Bottle," issued to Le Vaughn Kaopio represents one solution. It is described as a holder for a baby bottle having a cap with a nipple extending therethrough. The holder comprises an insulating jacket having a central aperture extending vertically therein. The insulation jacket is a stuffed animal and will protect the baby bottle from breakage while keeping a beverage within the baby bottle at a desired temperature. This holder has several disadvantages:

a) the inner aperture does not accommodate bottles of various circumferences;

b) the holder does not allow for the consumption of fluid in the bottle while the bottle is still in the holder;

c) the unit is not collapsible due to a hard inner aperture; and d) the holder is large and therefore difficult for a young child to hold by themselves.

OBJECTS AND ADVANTAGES

The objects and advantages of the simple bottle holder of the present invention include:

a) to provide a bottle holder that is simple and easy to use;

b) to provide a bottle holder in the form of an animal or creature;

c) to provide a holder that will provide insulation for a bottle;

d) to provide a bottle holder comprised entirely of soft, cuddly plush material;

e) to provide a bottle holder that offers an animated quality which is entertaining to a child;

(f) to provide a bottle holder that has an inner sheath that absorbs condensation from a cold bottle;

(g) to provide a bottle holder that can accommodate bottles of various sizes;

(h) to provide a bottle holder that is light and has appendages that allow for small hands to grasp and hold the unit for use;

(i) to provide a bottle holder that can be compressed for storage in a pocket or bag;

(j) to provide a bottle holder that is entirely machine washable; and (k) to provide a bottle holder that can be readily hung from a stroller.

BRIEF SUMMARY OF THE INVENTION

In accordance with the present invention a simple holder for a bottle comprises a plush material sheath in the form of a creature or animal.

DETAILED DESCRIPTION OF THE INVENTION

Preferred Embodiment

Figure 1:
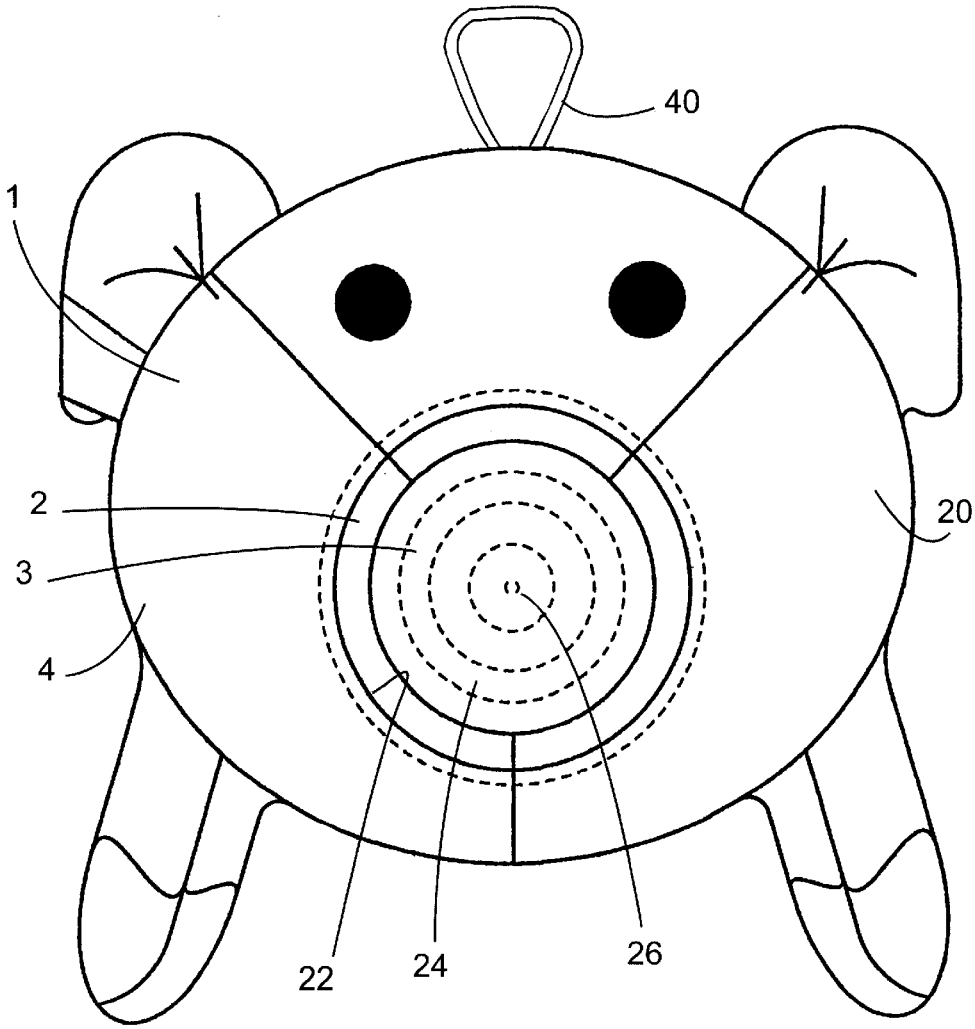
FIG. 1 is a top view of an exemplary embodiment of a bottle holder of the present invention.
Figure 2:
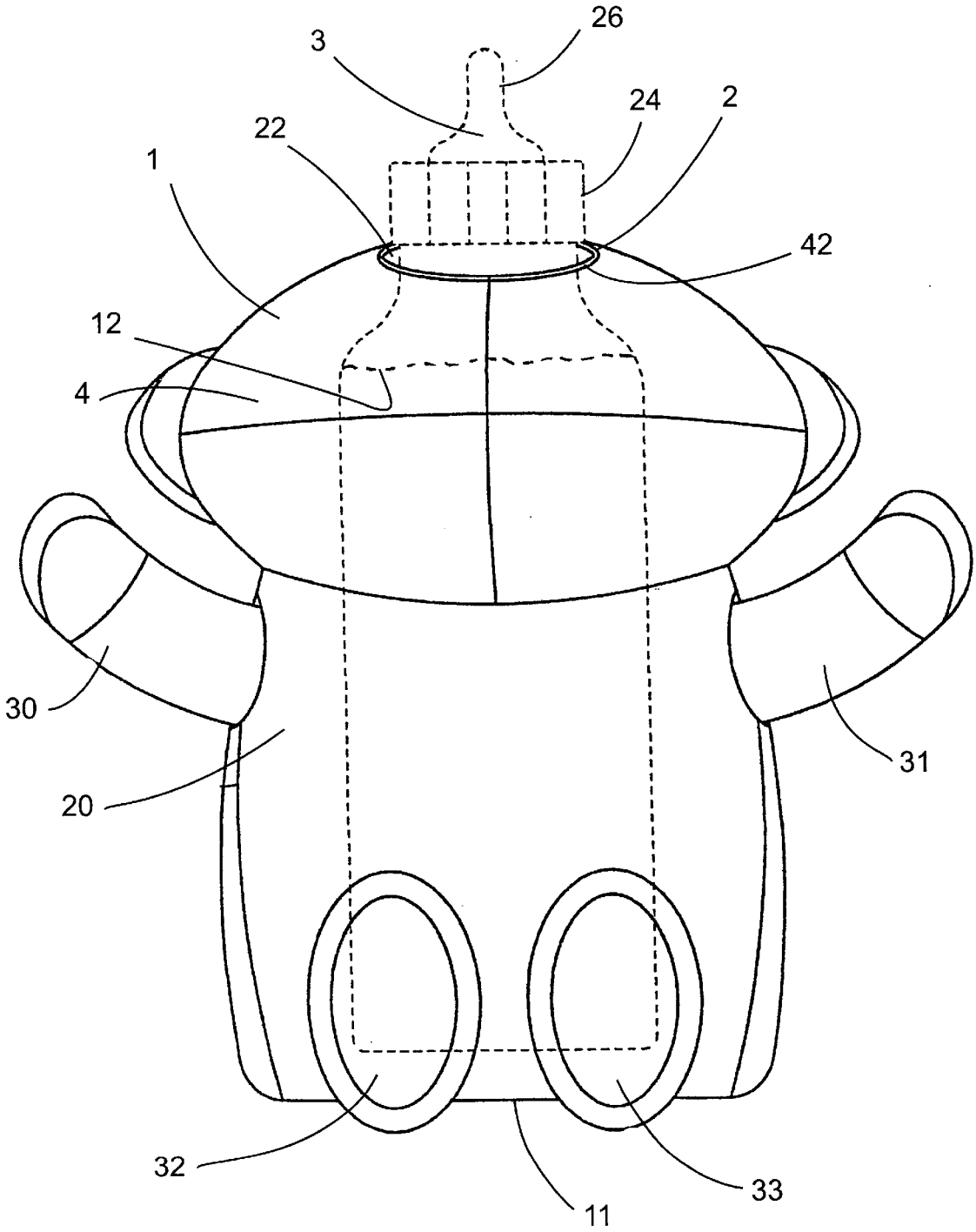
FIG. 2 is a front elevational view thereof.
Figure 3:
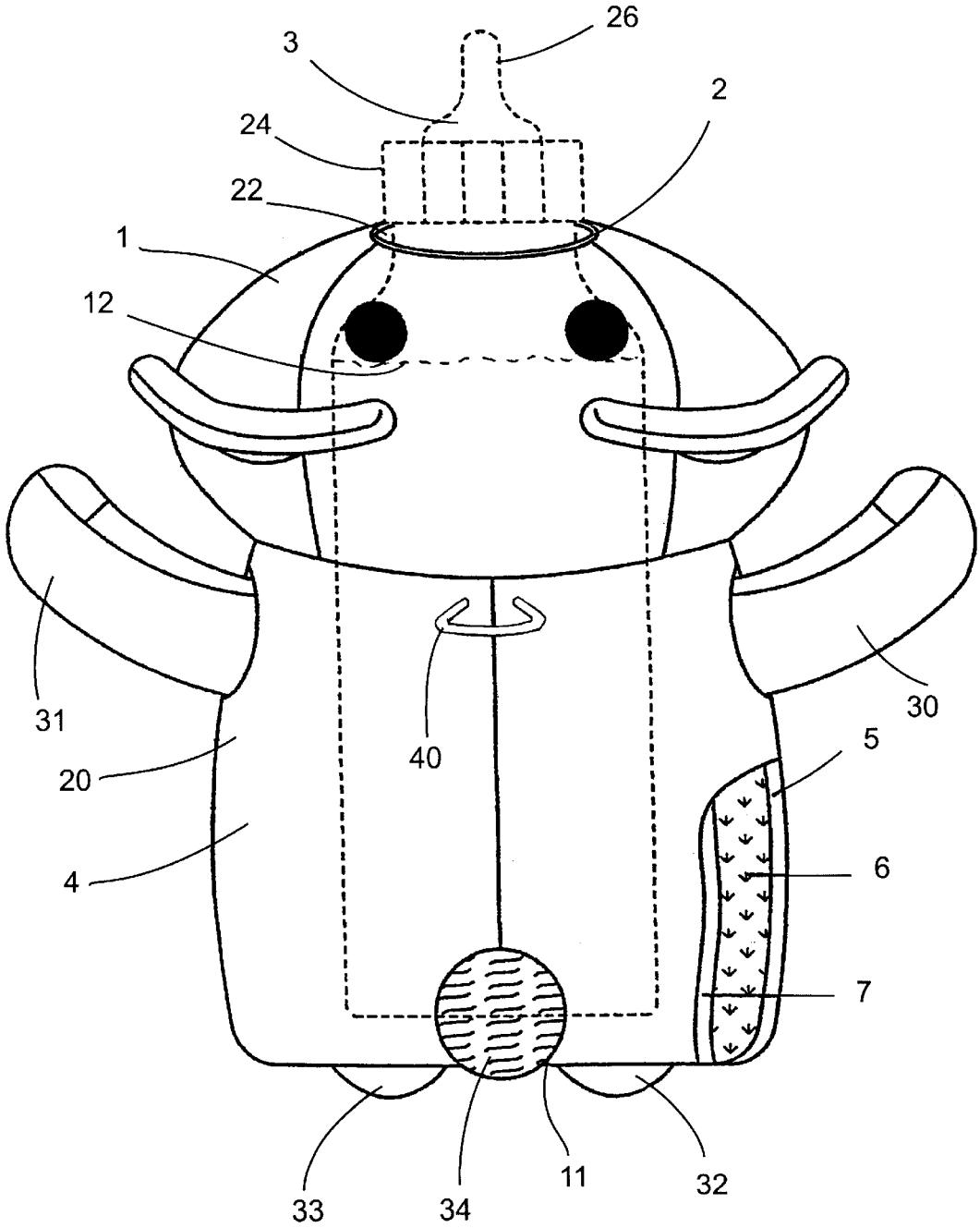
FIG. 3 is a rear elevational view thereof.

An exemplary embodiment of a bottle holder 1 according to the present invention is illustrated in FIG. 1. The holder 1 comprises an insulation jacket 4 having a soft inner sheath 7 extending vertically within, as shown in FIG. 3. More generally, as best shown in FIGS. 1–3, the bottle holder 1 comprises a body 20 having an internal passage 22 extending therethrough, the inside or inner sheath 7 of which is lined with a soft material. In the illustrated embodiment, the internal passage 22 through the body extends from a first or bottom opening 11 in the lower end of the body 20 to a second or top opening 2 in the upper end of the body 20. The internal passage 22 in the body 20 is adapted to receive a bottle 3 with at least a portion 24 of a drinking end 26 of the bottle 3 extending out of the internal passage 22.

Figure 4:
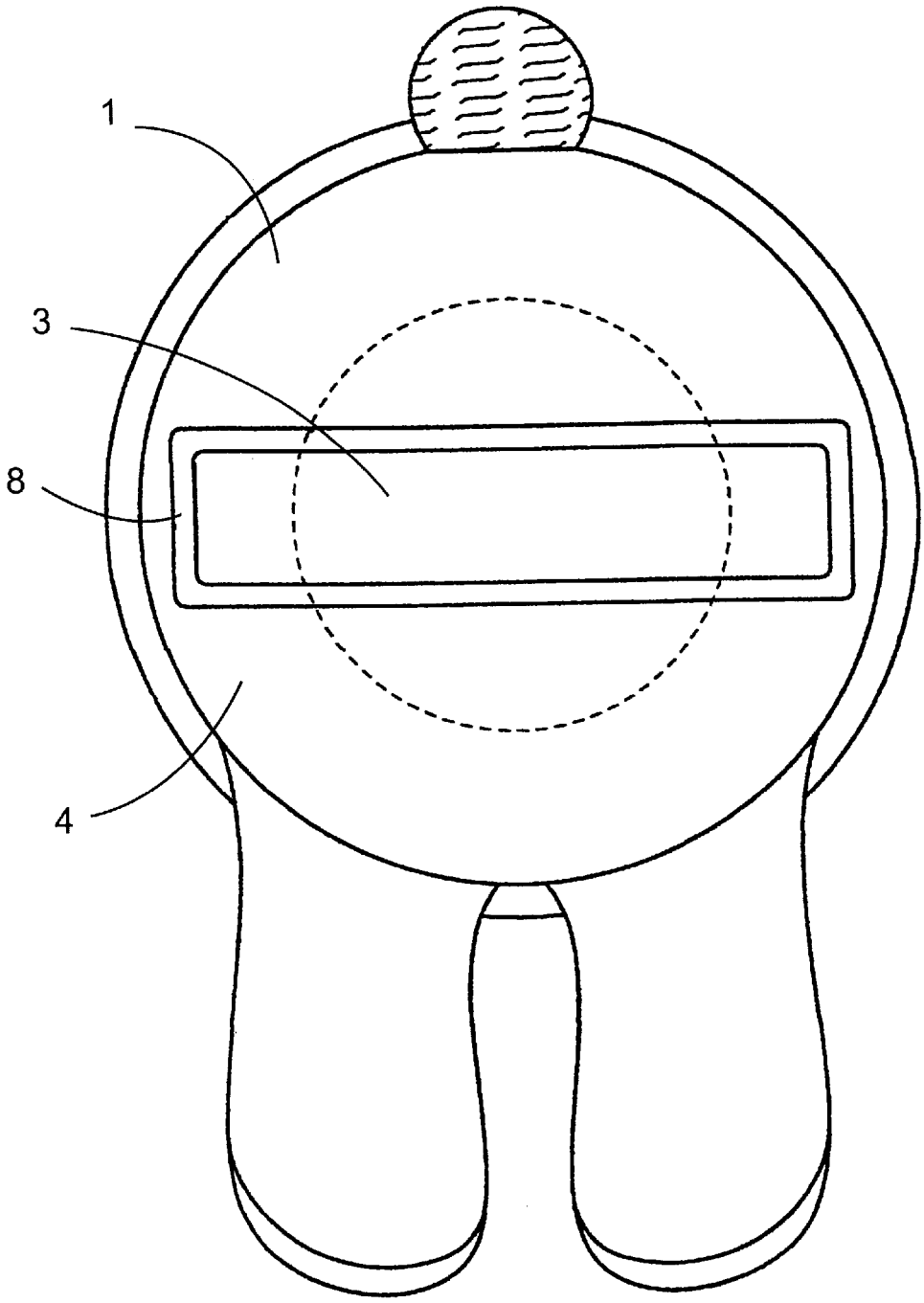
FIG. 4 is a bottom view thereof with a closure element of the bottle holder in the closed position.
Figure 5:
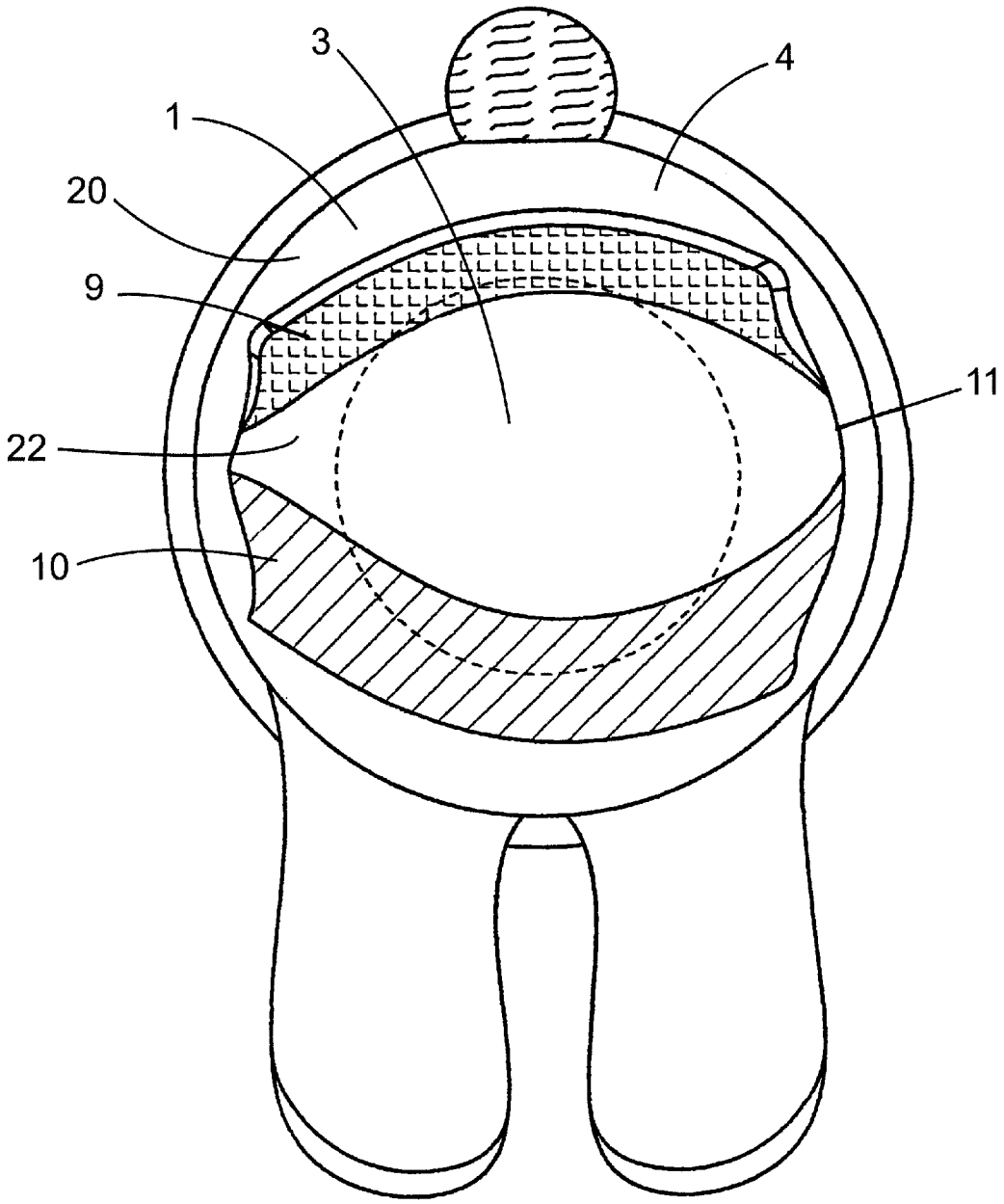
FIG. 5 is a bottom view thereof with the closure element in the open position.

In particular, as shown in FIGS. 2 and 3, the holder 1 is configured to receive a bottle 3 with the drinking end 26 of the bottle 3 extending through or beyond the top opening 2 in the holder 1. Referring to FIG. 5, to insert the bottle 3 in the holder 1, the bottle 3 can be urged through the bottom opening 11. Referring to FIGS. 4 and 5, the bottom opening 8 can be secured closed using hook and loop fastening tape 9, 10.

Referring to FIGS. 2 and 3, the body is in the form of an insulation jacket 4 which can keep the beverage 12 in the bottle 3 at a desired temperature. Referring to FIG. 3, the insulation jacket 4 of the holder 1 is comprised of three layers. The three layers consist of an outer fleece/plush material 5, a polyfill stuffing 6, and an inner sheath of plush material 7. These three layers provide insulation for the bottle 3. Additionally, the holder 1 absorbs condensation with its inner sheath 7 from the outside of cold bottle 3. The use of these materials also makes the bottle holder 1 easily washable.

There are various possibilities with regard to the materials used to create the holder 1. The outer material 5 could be any fabric that is soft and pleasing to the user. The inner sheath 7 could be any flexible material that possesses an absorbent and/or insulating quality. It will also be appreciated that any pliable or compressible filling material can be used for the stuffing. Advantageously, the use of pliable materials for the body 20 allows the holder 1 to be readily compressed for storage. When removed from storage, the holder 1 can return to its original shape. Moreover, the use of a pliable or compressible material allows the internal passage 22 of the sheath 7 to conform to bottles of varying size. In particular, the pliable nature of the body 20 allows the internal passage 22 to expand so as to accommodate bottles which may have a diameter larger than the "at rest" diameter of the internal passage (i.e., the diameter of the internal passage when the bottle holder is empty). In accommodating bottles of such larger sizes, the internal passage 22 of the holder 1 can expand without substantially deforming the outer material 5 of the body 20 such that the general outer shape of the body 20 can be maintained.

To amuse a user, the holder 1 is configured such that the bottle 3 forms an animal or creature when the bottle 3 is inserted in the holder 1. In particular, the body 20 of the holder 1 is configured and the top opening 2 in the body 20 is arranged such that the portion 24 of the bottle 3 that extends through the top opening 2 of the holder 1 forms a feature of a face of the animal or creature. For example, in the illustrated embodiment, the drinking end 26 of the bottle 3, which in the illustrated embodiment is a baby bottle, forms the nose, mouth or snout of a bear.

Referring to FIGS. 2 and 3, to assist a user such as a baby in gripping the holder, the body 20 can also include one or more appendages 30, 31, 32, 33, 34 such as arms, legs or a tail. In addition, a loop 40 or other hooking type element can be provided on the body 20, such as best shown in FIGS. 1 and 3, in order to allow the bottle holder 1 to be hung on something such as a stroller or exercise equipment. Although the preferred embodiment has been illustrated as being a bear any similar plush creature will do. For example, a cow, pig, or bunny requires minimal alterations. In other embodiments, a fanciful creature may also be used.

Operation of Preferred Embodiment

The manner of using the plush bottle holder 1 is simple. One can first open the bottom opening 11 and urge a 4–8 oz. baby bottle, an anti-spill cup (sometimes referred to as a "sippy" cup), one-pint water bottle, or sports bottle 3, for example, into and through the internal passage 22 of the sheath 7. The neck of the bottle 3 can then be adjusted so that it is fully extended through the top opening 2. (If a baby bottle is used, the collar of the bottle that holds the nipple can be extended entirely through the top opening.) When the neck and or collar is fully inserted, the beverage 12 can be consumed without the user's mouth coming in contact with the holder 1. The bottom 8 of the holder can be secured closed using the hook and loop fastening tape 9, 10. The beverage 12 can be consumed as needed.

To remove the bottle 3, one simply opens the hook and loop fastening tape 9, 10 and pulls the bottle 3 out of the holder 1.

If a material is used for the holder that has a very stretchable quality, the bottom opening 8 could be eliminated and the bottle 3 could be inserted through the top opening 2. An elastic band can be provided around a perimeter 42 of the top opening 2 to provide a snug, conforming fit between the top opening 2 and the bottle 3. The elastic band can help the top opening 2 retain its shape over extended use.

The internal passage 22 of the sheath 7 can be configured to retain the bottle 3 in the holder 1 while a user has positioned the bottle in a drinking position to drink the beverage 12. As will be appreciated, configuring the top opening 2 such that it is smaller than the bottom opening 11 facilitates retention of the bottle 3 in the bottle holder 1. Thus, when a user lifts the bottle holder 1 to drink from the bottle 3 held therein, the relatively smaller top opening 2 prevents the bottle 3 from sliding out of the bottle holder 1. As noted above, this can also be accomplished by using a stretchable material and sizing the top opening such that it is smaller in the un-stretched condition than the diameter of the main portion of any bottle that may be held in the bottle holder.

The hook and loop fastening tape 9, 10 at the bottom opening 8 of the holder, in turn, prevents a bottle from sliding downward out of the bottle holder 1. As will be appreciated, any suitable closure element that permits that bottom opening of the holder to be secured closed can be used. For example, snaps could be used, or, if baby safety is not an issue, a zipper or drawstring could be used.

From the description above, a number of advantages of the plush bottle holder of the present invention become evident. For example, because the bottle holder is comprised entirely of soft flexible material, it can expand to allow the insertion of a variety of bottle shapes and sizes. Moreover, since the bottle holder can be made with primarily only two materials (i.e., fabric and stuffing, the bottle holder can be easy and cost effective to manufacture and can be machine-washable. In addition, the holder's shape or configuration can be easily altered to represent a plethora of animals thereby providing many choices for the consumer.

CONCLUSION

Accordingly, the reader will see that the plush bottle holder can simply and easily hold a bottle while it insulates it and entertains the user with its animated quality. In addition, when it is used to hold a cold bottle it will absorb the condensation, thereby protecting items that may come in contact with the bottle, such as in a backpack or purse. Since it can accommodate bottles of various sizes it can be used by a variety of aged users as well.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

List of Reference Numbers Used:

1 holder for 3
2 holder's top opening or aperture
3 bottle
4 plush animal/creature insulation jacket of 1
5 outer fleece/plush material of 1
6 polyfill stuffing of 1
7 inner sheath fleece/plush material of 1
8 bottom opening: closed position of 1
9 hook and loop fastening tape: hook side of 8
10 hook and loop fastening tape: loop side of 8
11 bottom opening: open position of 1
12 beverage
20 body of 1
22 internal passage 1
24 portion of 3
26 drinking end of 3
30 appendage of 1
31 appendage of 1
32 appendage of 1
33 appendage of 1
34 appendage of 1
40 loop of 1
42 perimeter of 1.

What is claimed is:

1.A holder for a bottle that forms an animal or creature when the bottle is inserted in the hold , the holder comprising a body having an internal passage extending therethrough from bottom opening in the body to a top opening in the body, the internal passage being configured to receive a bottle with a portion of the bottle extending beyond the top opening in th body, the body being configured and the top opening being arranged on the body such that the portion of the bottle extending beyond the top opening forms an element of a face oft e animal or creature, a closure element arranged on the body so as to bc operable to selectively close the bottom opening and wherein the internal passage is configured such that a bottle received in the internal passage is retained so as to allow fluid to be consumed from the bottle.

2. The older for a bottle as described in claim 1 wherein the closure element comprises cooperating hook and loop fastening tape strips.

3. The older for a bottle as described in claim 1 wherein the internal passage has a first size when the bottle is not inserted in the holder, and the body is pliable and resilient such th t the internal passage can expand to a second size to accommodate a bottle which is larger than the first size, the second size being larger than the first size.

4. The older for a bottle as described in claim 1 wherein the body includes a loop for hanging th holder.

5. The holder for a bottle as described in claim 1 wherein the top opening is relatively smaller than the bottom opening.

* * * * *

UNITED STATES PATENT AND TRADEMARK OFFICE

CERTIFICATE OF CORRECTION

PATENT NO. : 6,641,094 B2
DATED : November 4, 2003
INVENTOR(S) : Brenda C. Fishler It is certified that error appears in the above-identified patent and that said Letters Patent is hereby corrected as shown below:

Column 6,
Lines 17 and 36, “th” should read -- the --.
Line 20, “oft e” should read -- of the --.
Lines 26, 29 and 35, “older” should read -- holder --.
Line 32, “th t” should read -- that the --.

Signed and Sealed this

Twelfth Day of October, 2004

JON W. DUDAS
*Director of the United States Patent and Trademark Office*